US010864451B2

(12) United States Patent
Gupta

(10) Patent No.: US 10,864,451 B2
(45) Date of Patent: Dec. 15, 2020

(54) PACKAGING BOX FOR A TOY CAR

(71) Applicant: Prachi Gupta, New Delhi (IN)

(72) Inventor: Prachi Gupta, New Delhi (IN)

( * ) Notice: Subject to any disclaimer, the term of this patent is extended or adjusted under 35 U.S.C. 154(b) by 0 days.

(21) Appl. No.: 16/633,838

(22) PCT Filed: Aug. 2, 2018

(86) PCT No.: PCT/IB2018/055802
§ 371 (c)(1),
(2) Date: Jan. 24, 2020

(87) PCT Pub. No.: WO2019/197889
PCT Pub. Date: Oct. 17, 2019

(65) Prior Publication Data

US 2020/0238186 A1 Jul. 30, 2020

(30) Foreign Application Priority Data

Apr. 12, 2018 (IN) ..... 201811014021

(51) Int. Cl.

| | |
|---|---|
| ***A63H 33/04*** | (2006.01) |
| ***A63H 17/00*** | (2006.01) |
| ***A63H 17/26*** | (2006.01) |
| ***B65D 25/02*** | (2006.01) |
| ***B65D 25/54*** | (2006.01) |
| ***B65D 43/02*** | (2006.01) |

(52) U.S. Cl.
CPC ..... *A63H 17/008* (2013.01); *A63H 17/26* (2013.01); *B65D 25/02* (2013.01); *B65D 25/54* (2013.01); *B65D 43/02* (2013.01); *B65D 2313/04* (2013.01)

(58) Field of Classification Search
CPC ..... A63H 17/0008; B65D 2313/04; B65D 25/02; B65D 43/02
USPC ..... 446/71–81
See application file for complete search history.

(56) References Cited

U.S. PATENT DOCUMENTS 2,008,664 A * 7/1935 Dowst ..... B65D 5/5059 206/563
3,057,466 A * 10/1962 Blonder ..... B65D 5/5007 206/781
3,576,253 A * 4/1971 Keats ..... B65D 5/5035 206/783

(Continued)

FOREIGN PATENT DOCUMENTS

EP 1123239 B1 9/2002

OTHER PUBLICATIONS

Dec. 17, 2018—(WO) International Search Report and Written Opinion—APP PCT/IB2018/055802.

*Primary Examiner* — Eugene L Kim
*Assistant Examiner* — Matthew B Stanczak
(74) *Attorney, Agent, or Firm* — Banner & Witcoff, Ltd.

(57) ABSTRACT

The present disclosure relates to packaging boxes for toy cars. The packaging box of the present disclosure serves a dual purpose, firstly for packaging the toy car and secondly, the packaging box serves as an accessory for the toy car. The packaging box comprises a container element and a lid element, each comprising at least one upright longitudinal sidewall and at least one lateral foldable sidewall, wherein the longitudinal sidewall and the foldable sidewall of the container element and the lid element engage with each other defining a track, which can be employed for displacing the toy car thereon.

12 Claims, 10 Drawing Sheets

(56) References Cited

U.S. PATENT DOCUMENTS 3,847,276 A * 11/1974 Lehner ..... B65D 5/5026 206/782
4,285,157 A * 8/1981 Lambert ..... A63H 18/028 104/55
4,349,983 A * 9/1982 Kilroy ..... A63H 18/02 220/23.4
4,403,440 A * 9/1983 Wulff ..... A63H 18/026 446/430
4,433,504 A * 2/1984 Terui ..... A63H 17/44 446/429
4,473,969 A * 10/1984 Wilson ..... A63H 17/44 224/219
4,516,948 A * 5/1985 Obara ..... A63H 33/003 446/376
4,527,688 A * 7/1985 Jones ..... A63H 33/00 206/315.1
4,581,904 A * 4/1986 Lehmann ..... A63H 3/16 446/310
4,595,097 A * 6/1986 Herstein ..... B65D 5/50 206/335
4,690,654 A * 9/1987 DeLaney ..... A63H 17/008 124/16
4,737,135 A * 4/1988 Johnson ..... A63H 17/008 446/430
4,755,159 A * 7/1988 Templeton ..... A63H 3/52 446/110
4,894,039 A * 1/1990 Taylor ..... A63H 27/10 229/110
4,905,828 A * 3/1990 Dods ..... B65D 75/36 206/335
4,946,413 A * 8/1990 Lehmann ..... A63H 17/008 446/28
5,098,327 A * 3/1992 Ferrero ..... A63F 9/001 446/75
5,411,138 A * 5/1995 Klawiter ..... B65D 5/5088 206/335
5,542,870 A * 8/1996 Westersund ..... A63H 33/062 220/324
5,896,991 A * 4/1999 Hippely ..... B65D 73/0021 206/461
5,984,755 A * 11/1999 Avey ..... A63H 17/05 206/765
6,152,298 A * 11/2000 Dods ..... B65D 75/36 206/335
6,409,568 B1 * 6/2002 Søgaard ..... B65D 5/4204 446/73
6,572,436 B1 * 6/2003 So ..... A63H 17/44 446/478
7,296,679 B2 * 11/2007 Lam ..... B65D 5/5088 206/335
7,618,302 B2 * 11/2009 Collins ..... A63H 18/02 446/168
7,637,377 B1 * 12/2009 Peckholdt, Jr. ..... A63H 33/42 206/579
8,025,151 B1 * 9/2011 Pertruff ..... B65D 73/0085 206/769
8,668,081 B2 * 3/2014 Hippely ..... A63H 33/003 206/223
8,790,152 B2 * 7/2014 Schlegel ..... A63H 18/02 446/168
9,050,994 B2 * 6/2015 Nuttall ..... B62B 1/14
9,731,210 B2 * 8/2017 Lennon ..... A63H 17/008
10,518,185 B1 * 12/2019 Welby ..... A63H 18/00
2002/0182974 A1 12/2002 Grabianski
2005/0145535 A1 * 7/2005 Augborne ..... B65D 25/10 206/736
2005/0245168 A1 * 11/2005 Kay ..... A63H 17/44 446/128
2005/0287903 A1 * 12/2005 Augborne ..... B65D 75/366 446/75
2006/0021905 A1 * 2/2006 Johnson ..... A63H 19/36 206/736
2006/0135035 A1 * 6/2006 Leung ..... A63H 17/44 446/456
2007/0197122 A1 * 8/2007 O'Keefe ..... A63H 17/26 446/75
2007/0218800 A1 * 9/2007 Benedict ..... A63H 33/00 446/75
2008/0014832 A1 * 1/2008 Ostendorff ..... A63H 18/00 446/444
2009/0170395 A1 * 7/2009 Wai ..... A63H 30/04 446/38
2011/0130068 A1 * 6/2011 Nuttall ..... A63H 18/026 446/75
2012/0208431 A1 * 8/2012 Screnci ..... A63H 17/44 446/476
2012/0264347 A1 * 10/2012 Barthold ..... A63H 33/42 446/75
2014/0256219 A1 * 9/2014 Lennon ..... A63H 17/008 446/429
2017/0066586 A1 * 3/2017 Petty ..... B65D 5/6667
2018/0297746 A1 * 10/2018 Sneddon ..... B65D 21/0213
2020/0078696 A1 * 3/2020 Womack ..... A63H 17/05
2020/0238186 A1 * 7/2020 Gupta ..... A63H 17/008

* cited by examiner

PACKAGING BOX FOR A TOY CAR

CROSS-REFERENCE TO RELATED APPLICATIONS

The present application is a U.S. National Phase of International PCT Application No. PCT/IB2018/055802 filed on Aug. 2, 2018, designating the United States of America and claiming priority to Indian Patent Application No 201811014021 filed on Apr. 12, 2018. This application claims priority to and the benefit of the above-identified applications, which are fully incorporated by reference herein in their entirety.

TECHNICAL FIELD OF INVENTION

The present disclosure relates to the field of packaging. In particular, the present disclosure relates to the field of packaging boxes for toy cars.

BACKGROUND ART

Typical packaging of toy cars involves the use of clamshell packaging. However, the clamshell packaging, although serves the purpose of providing a tamper-evident packaging, provides a very inconvenient and uncomfortable end user experience. In some cases, injuries such as cuts and bruises have also been reported to have been caused by the use of the clamshell packaging.

Another method of packaging the toy cars are card board boxes. Some toy car manufacturers go a step further in their marketing strategies and provide a track along with the toy car for allowing the end users to make use of an additional element while playing with a toy car which has no mechanism of its own for automation. Typically, the end users may include children and collectors. The tracks provided by the manufacturers are typically made of a plastic material and increase not just the cost of the toy, but also product manufacturing in general, as they are sold in separate packaging as toy car "sets" accompanying a toy car.

A need, therefore, exists to provide a packaging box for toy cars which is convenient and easy to use, while at the same time cuts the packaging waste as well as the costs associated with the provision of tracks.

BRIEF DISCLOSURE OF THE INVENTION

The present disclosure relates to packaging boxes for toy cars. In particular, the present disclosure provides a packaging box for a toy car, wherein the packaging box serves a dual purpose, firstly for packaging the toy car and secondly, the packaging box serves as an accessory for the toy car.

In accordance with an embodiment of the present disclosure, a packaging box for a toy car, said packaging box comprising a container element configured to contain said toy car, said container element having a base, at least one upright longitudinal sidewall extending from at least one longitudinal side of said base and at least one lateral foldable sidewall extending from at least one lateral side of said base, wherein in a folded configuration of said at least one lateral foldable sidewall, said container element defines a box-like structure for containing said toy car, a lid element configured to be assembled with said container element to define said packaging box, said lid element having a top, at least one upright longitudinal sidewall extending from at least one longitudinal side of said top; and at least one lateral foldable sidewall extending from at least one lateral side of said top, characterized in that said at least one lateral foldable sidewall of said container element and said at least one lateral foldable sidewall of said lid element, each in an unfolded configuration thereof are engageable with each other to define a track for said toy car to be displaced thereon.

BRIEF DESCRIPTION OF DRAWING

The aspects and other features of the subject matter will be better understood with regard to the following description, appended claims, and accompanying figures. The use of the same reference number in different figures indicates similar or identical items.

DETAILED DESCRIPTION OF THE INVENTION

The present disclosure relates to packaging boxes for toy cars. In particular, the present disclosure provides a packaging box for a toy car, wherein the packaging box serves a dual purpose, firstly for packaging the toy car and secondly, the packaging box serves as an accessory for the toy car.

Figures 1A, 1B:
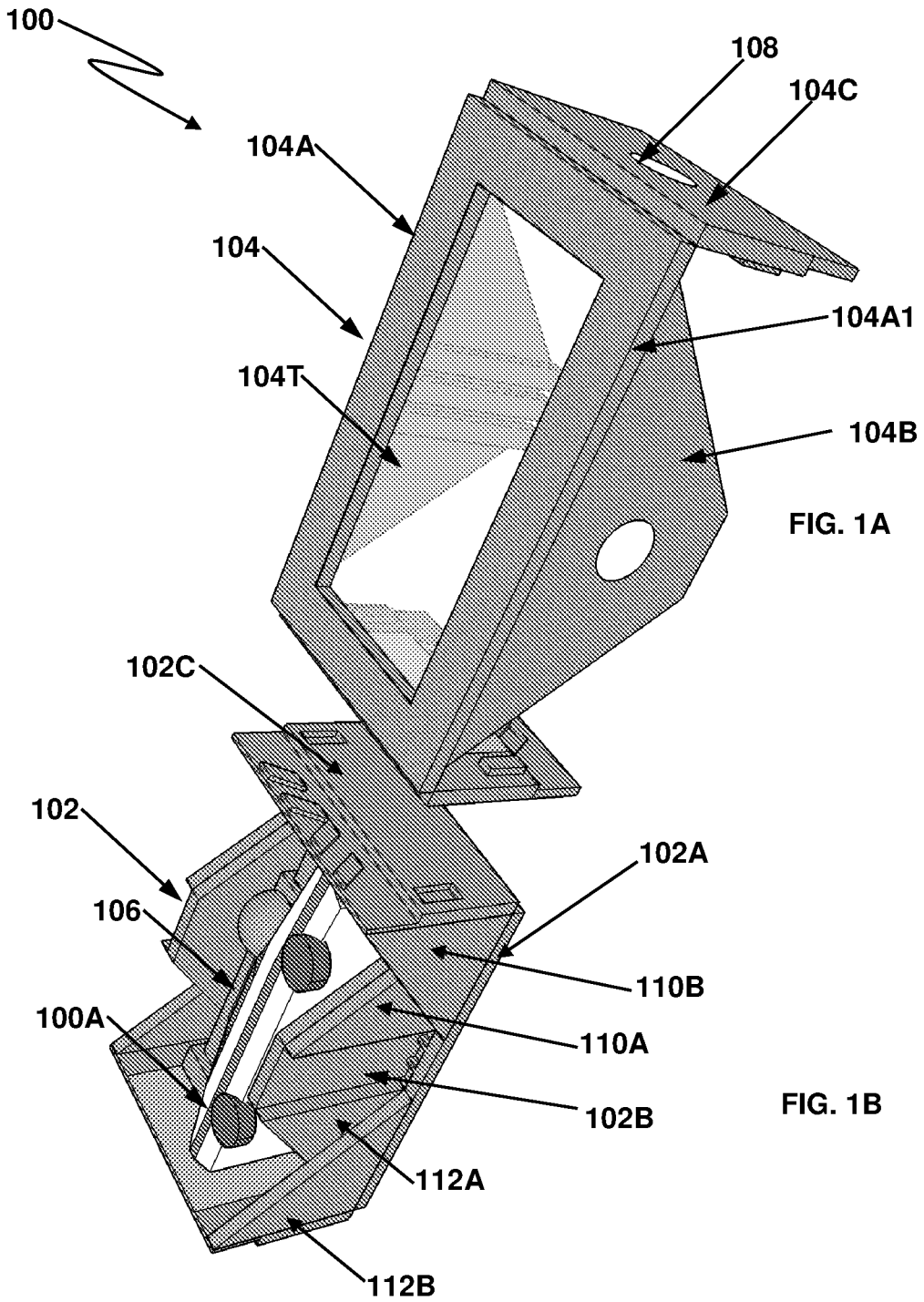
FIG. 1A and FIG. 1B illustrate an isometric view of a lid element and a container element, respectively, of a packaging box in accordance with an embodiment of the present disclosure.
Figure 1C:
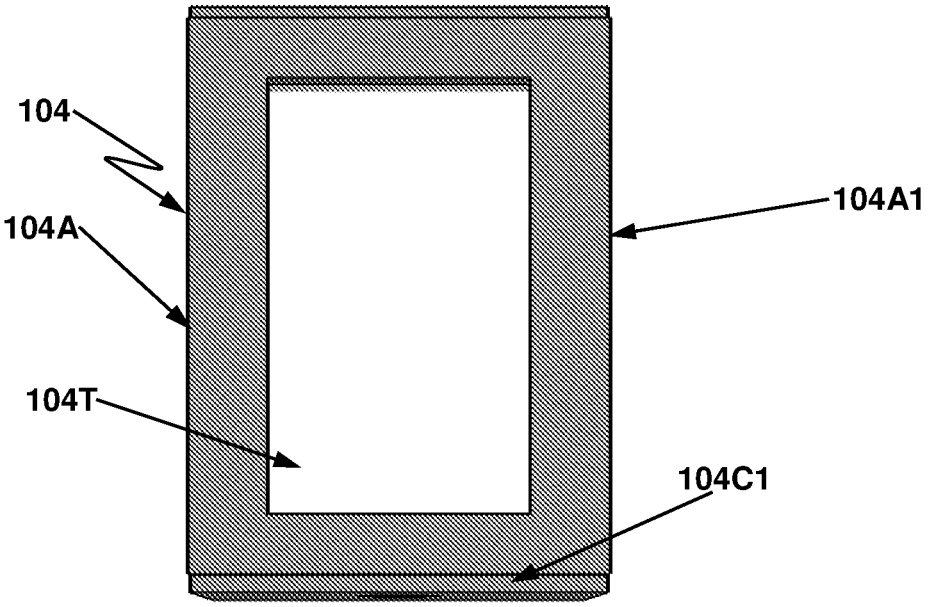
FIG. 1C and FIG. 1D illustrate a top view of the lid element and the container element with a car and the accessory (launcher stick), respectively, of the packaging box of FIG. 1A
Figure 1D:
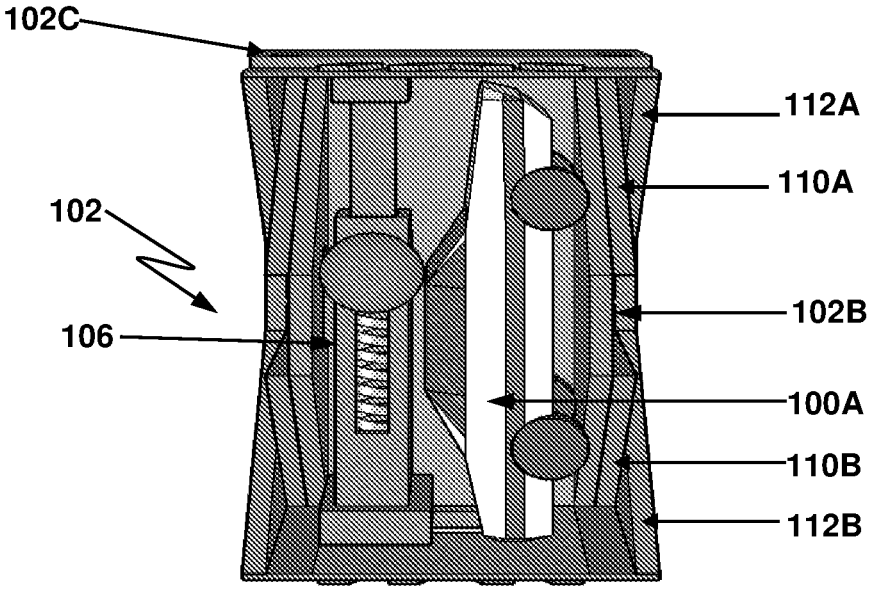
Figure 2A:
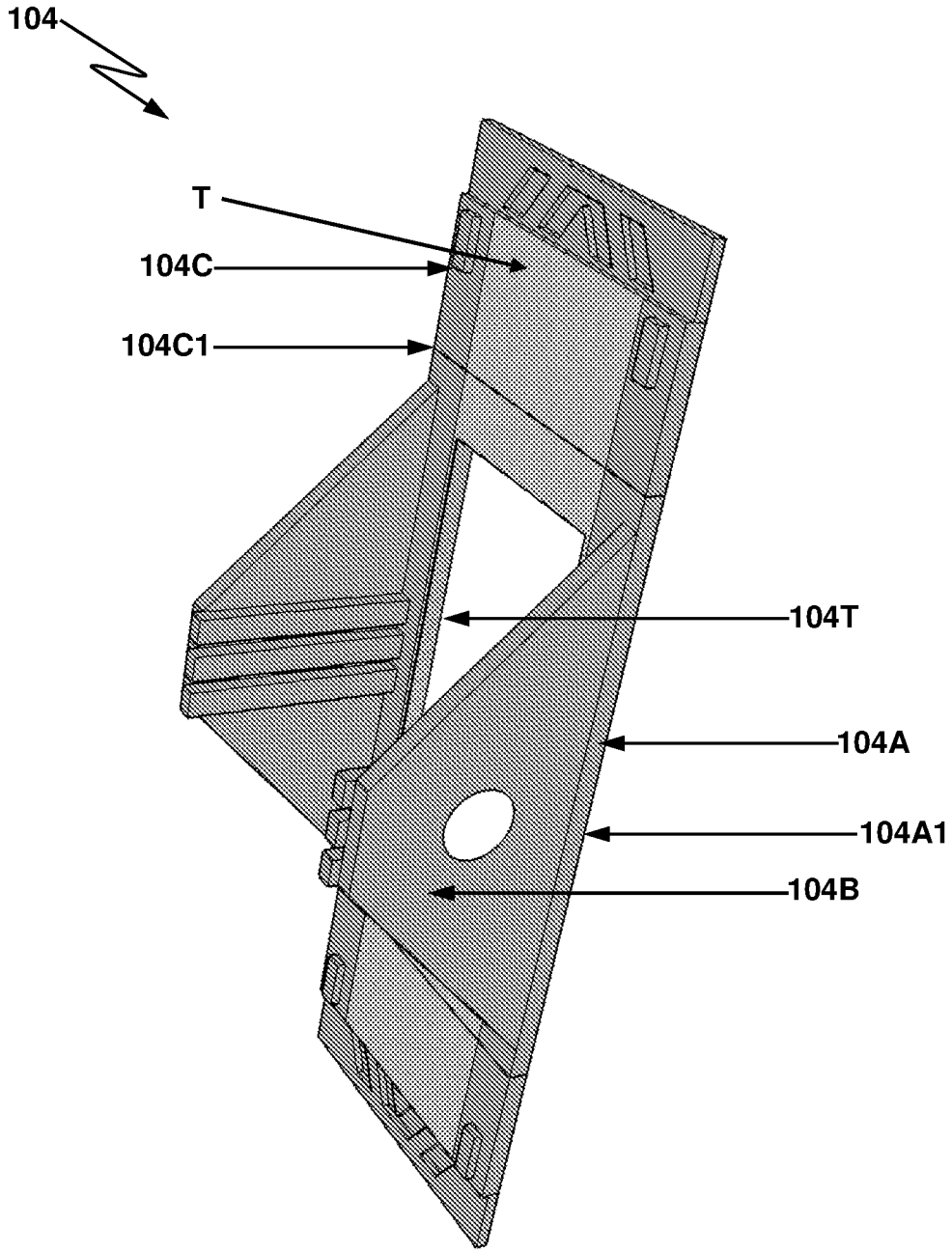
FIG. 2A illustrates an isometric view of the lid element, in an unfolded configuration, of the packaging box of FIG. 1A.
Figure 2B:
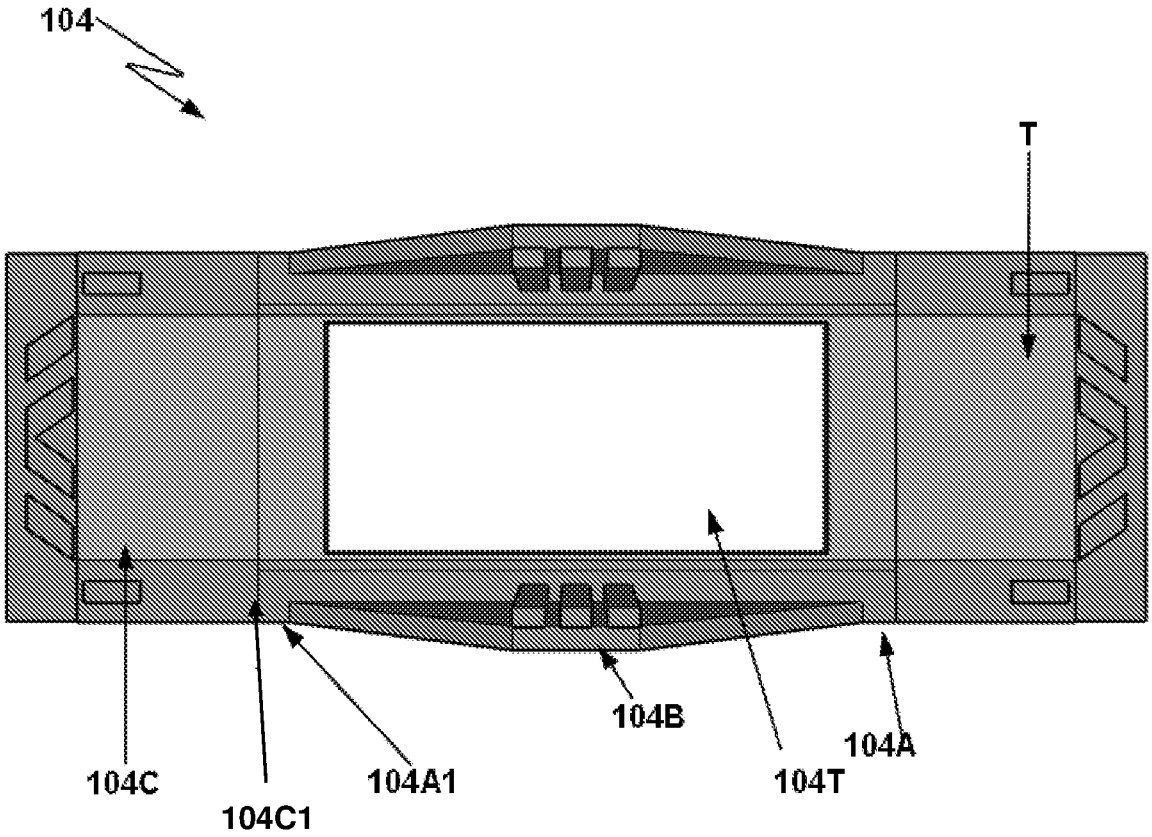
FIG. 2B illustrates a top view of the lid element of FIG. 2A.
Figure 2C:
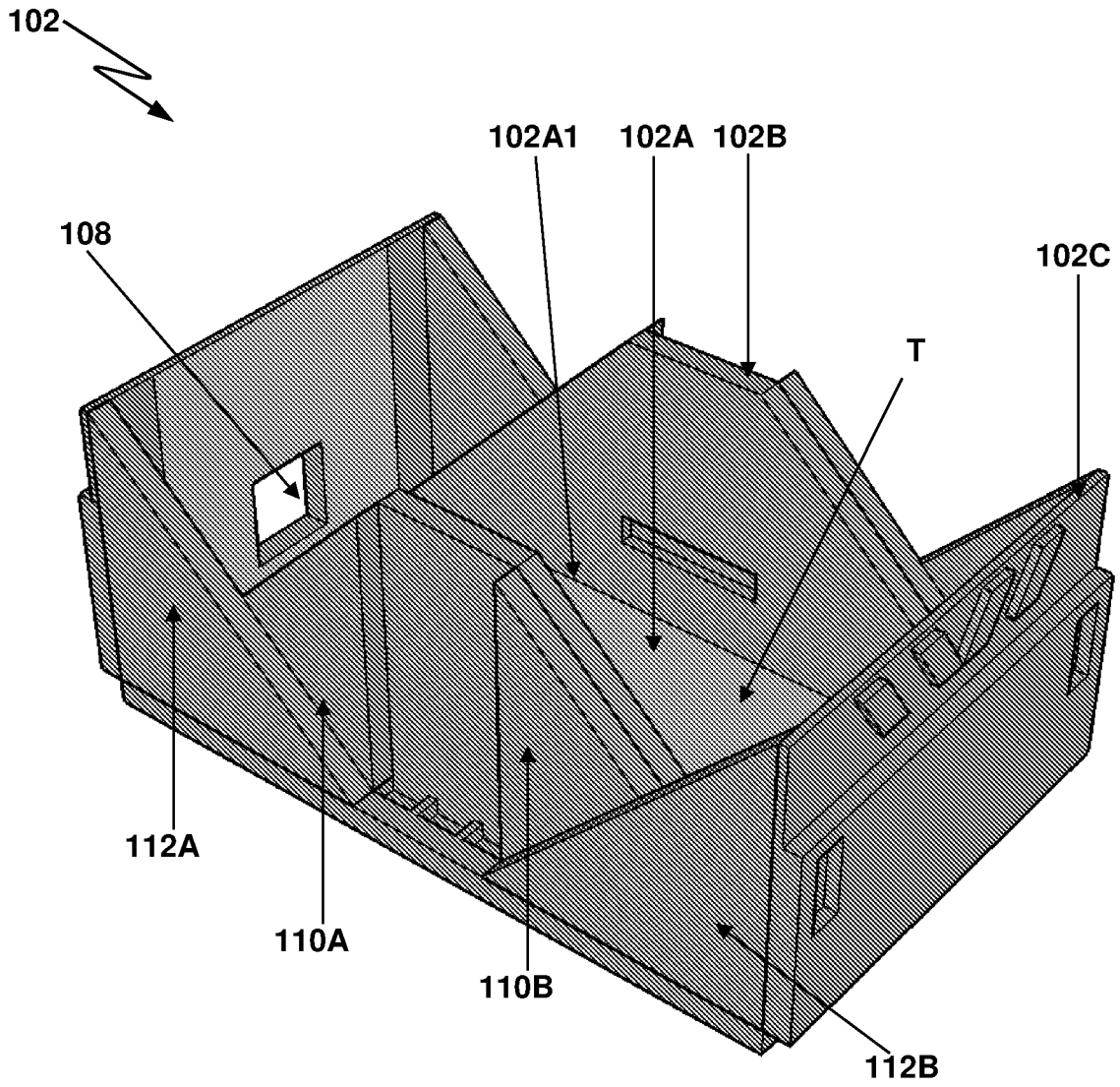
FIG. 2C illustrates an isometric view of the container element with at least one upright longitudinal sidewall, and at least one lateral foldable sidewall in the folded configuration.
Figure 2D:
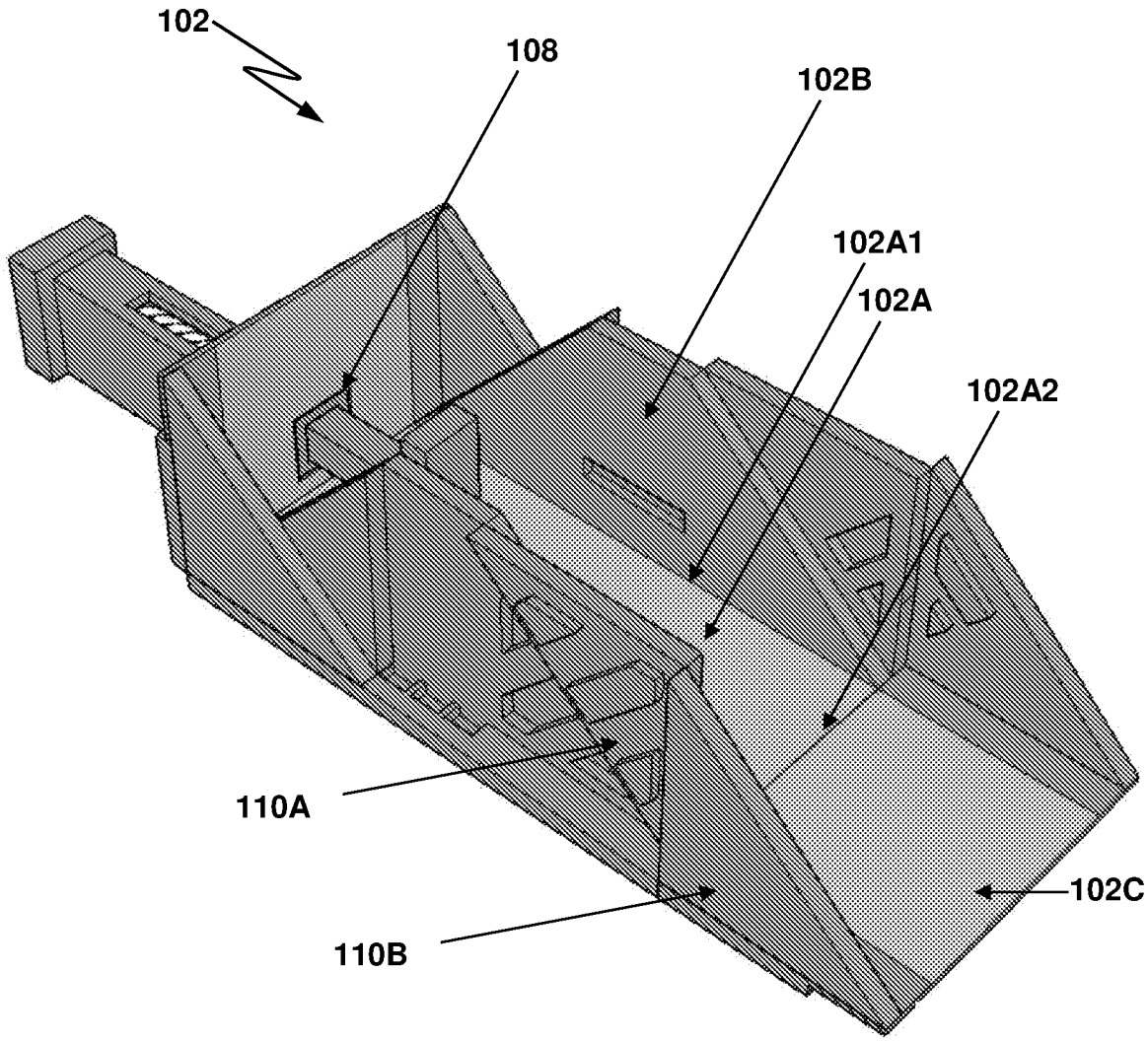
FIG. 2D illustrates another isometric view of the container element of the present invention.
Figure 3A:
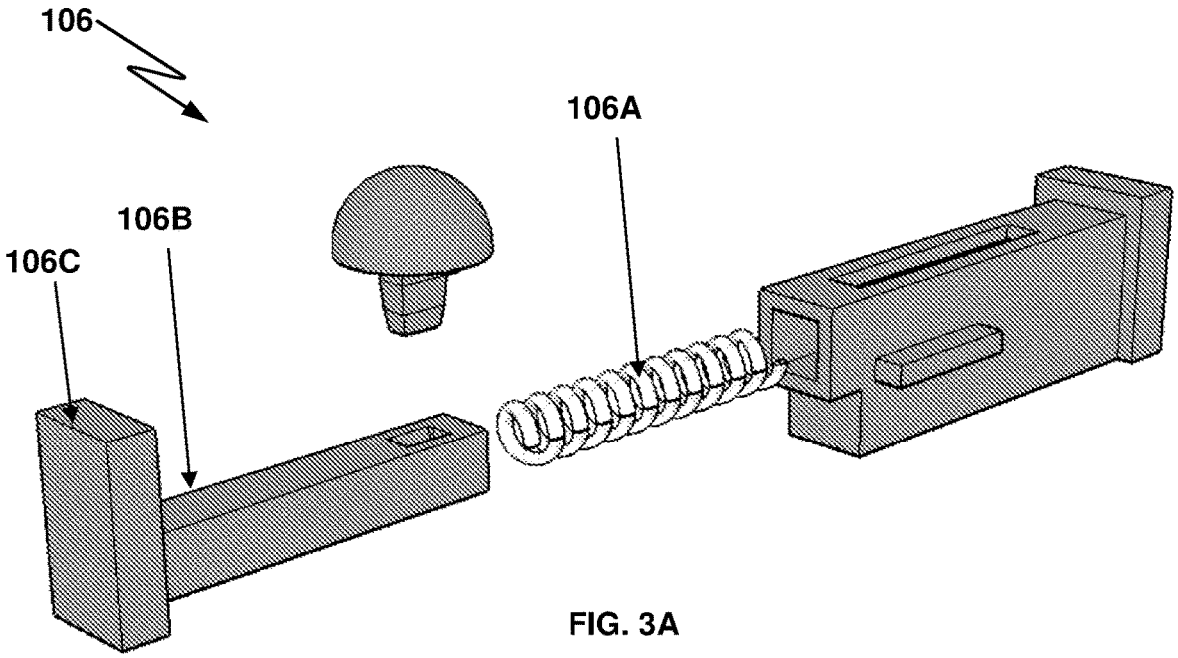
FIG. 3A illustrates an isometric view of the components of a car launcher before assembly, in accordance with an embodiment of the present disclosure.
Figure 3B:
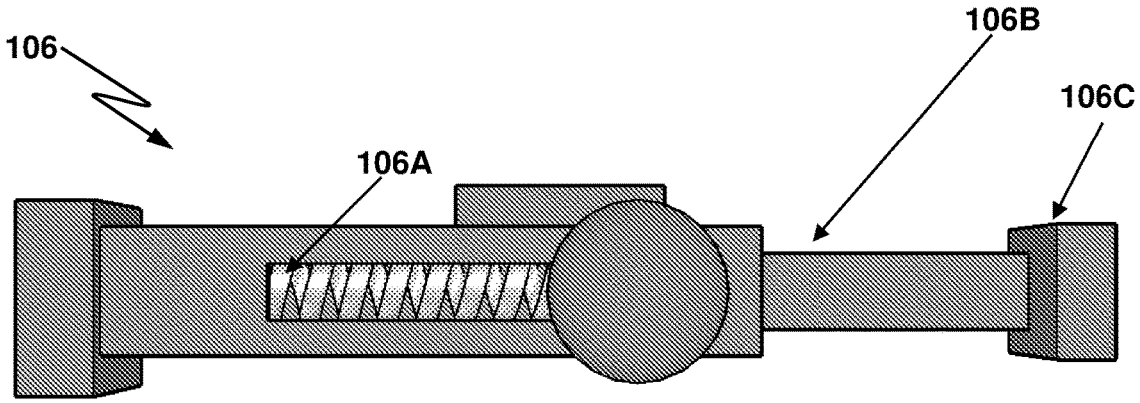
FIG. 3B illustrates a top view of the car launcher (after assembly) of FIG. 3A.
Figure 4:
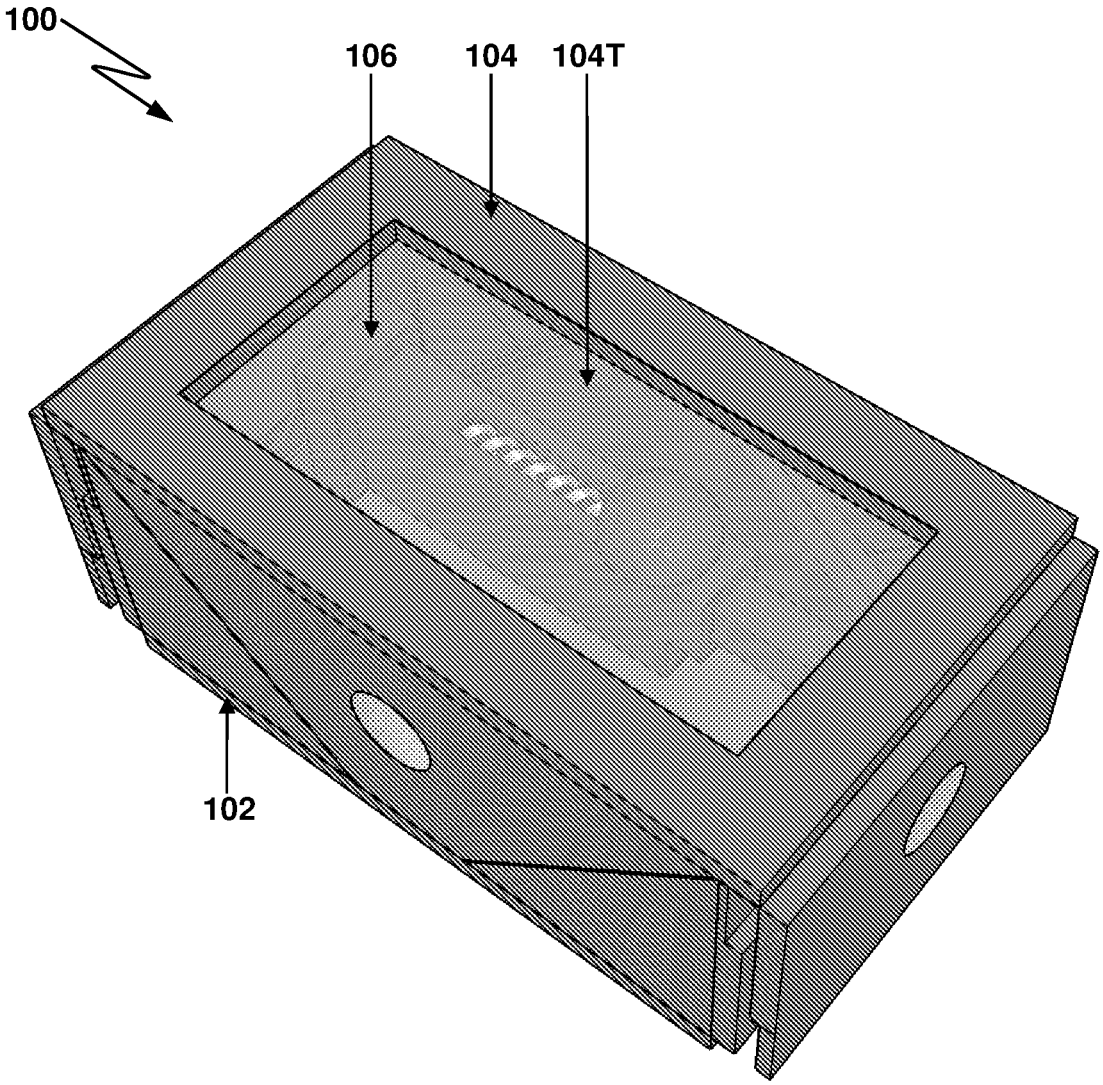
FIG. 4 illustrates an isometric view of a packaging box comprised of the container element and the lid element along with the launcher element engaged to define the packaging box of the present disclosure.
Figure 5A:
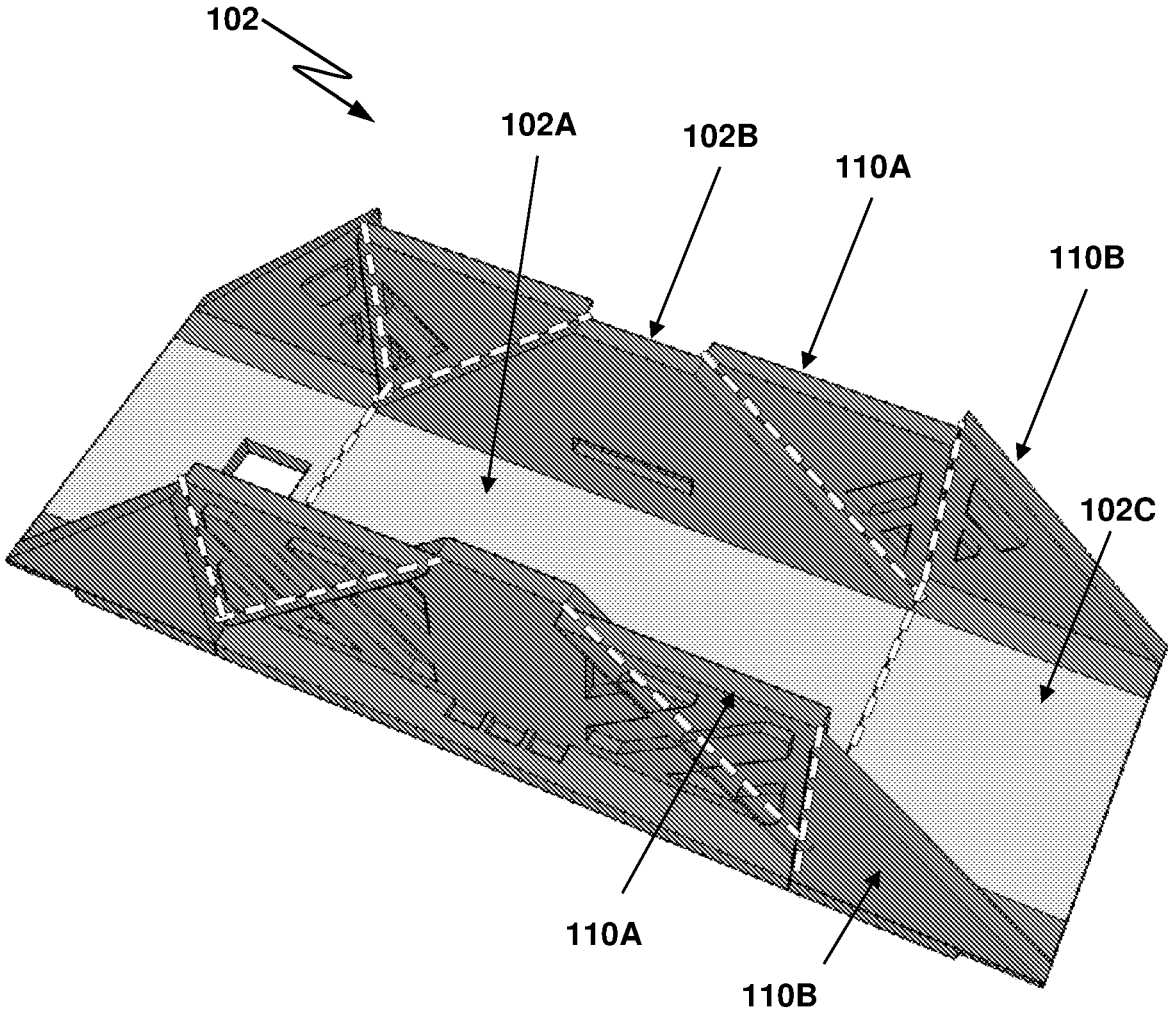
FIG. 5A illustrates the isometric view of the container element of the packaging box of the present invention, in which the live hinges are indicated via dotted lines.
Figure 5B:
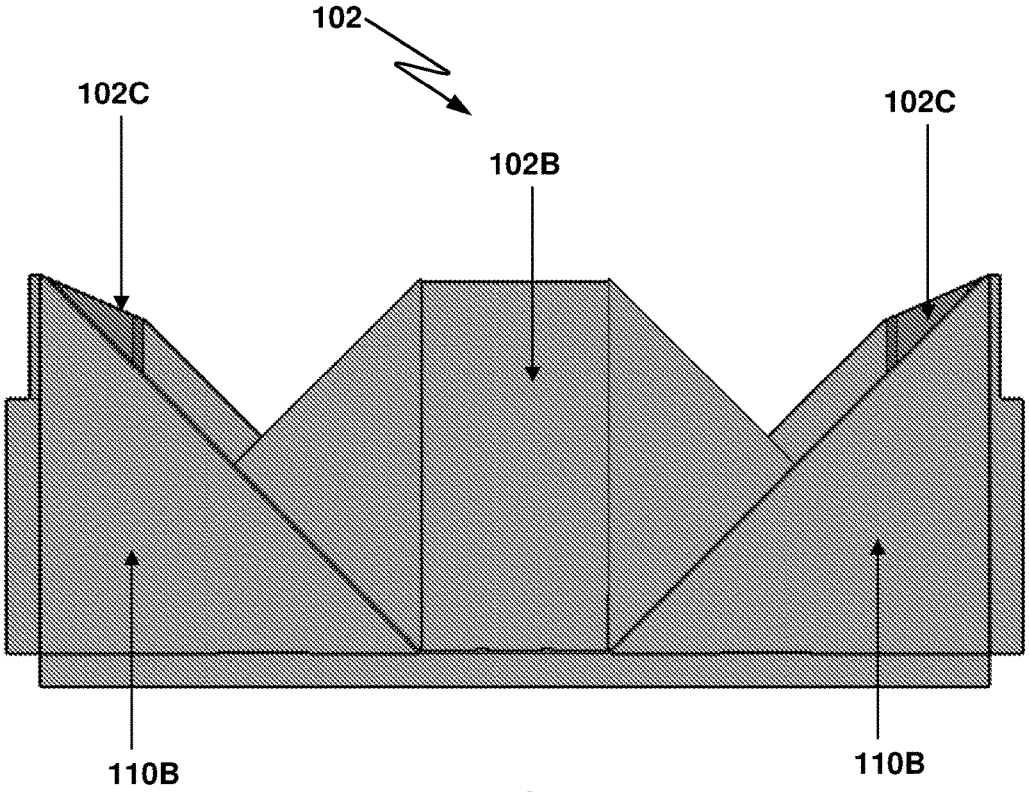
FIG. 5B and FIG. 5C illustrate side views of the container element of the packaging box of the present invention, in illustrating the opening mechanism of the foldable extensions of the at least one upright longitudinal sidewall.
Figure 5C:
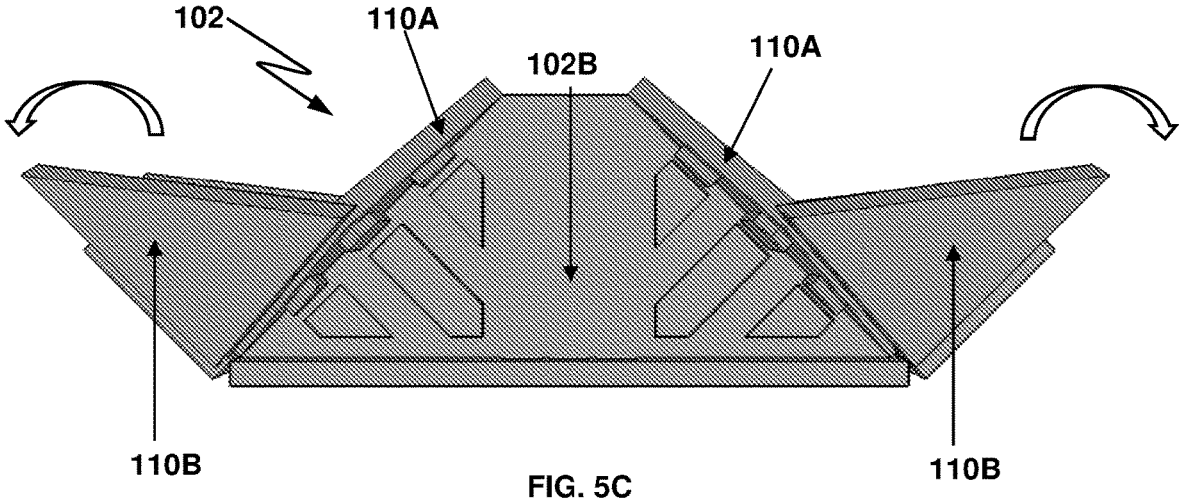

The packaging box of the present disclosure is described herein below with reference to FIG. 1A and FIG. 1B illustrate an isometric view a lid element and a container element, respectively, of a packaging box in accordance with an embodiment of the present disclosure, FIG. 1C and FIG. 1D illustrate a top view of the lid element and the container element, respectively, of the packaging box of FIG. 1A, FIG. 2A illustrates an isometric view of the lid element, in an unfolded configuration, of the packaging box of FIG. 1A, FIG. 2B illustrates a top view of the lid element of FIG. 2A, FIG. 2C and FIG. 2D illustrate isometric views of the container element, FIG. 3A illustrates an isometric view of a car launcher in accordance with an embodiment of the present disclosure, FIG. 3B illustrates a top view of the car launcher of FIG. 3A, FIG. 4 illustrates an isometric view of a packaging box with the container element and the lid element engaged to define the packaging box of the present disclosure, FIG. 5A illustrates the isometric view of the container element of the packaging box of the present invention, in which the live hinges are indicated via dotted lines, and FIG. 5B and FIG. 5C illustrate side views of the container element of the packaging box of the present invention, in illustrating the opening mechanism of the foldable extensions of the at least one upright longitudinal sidewall.

In accordance with the present disclosure, the packaging box (100) for a toy car comprises a container element (102) and a lid element (104). The container element (102) is configured to contain said toy car (100A). The container element (102) comprises a base (102A), at least one upright longitudinal sidewall (102B) extending from at least one longitudinal side (102A1) of said base (102A), and at least one lateral foldable sidewall (102C) extending from at least one lateral side (102A2) of said base (102A), wherein in a folded configuration of said at least one lateral foldable sidewall (102C), said container element (102) defines a box-like structure for containing said toy car (100A).

Further, the lid element (104) is configured to be assembled with said container element (102) to define said packaging box (100). The lid element (104) comprises a top (104A), at least one upright longitudinal sidewall (104B) extending from at least one longitudinal side (104A1) of said top (104A) and at least one lateral foldable sidewall (104C) extending from at least one lateral side (104C1) of said top (104A);

In accordance with the present disclosure, said at least one lateral foldable sidewall (102C) of said container element (102) and said at least one lateral foldable sidewall (104C) of said lid element (104), each in an unfolded configuration thereof, are engageable with each other to define a track (T) for said toy car to be displaced thereon, i.e., a child or interested person can use this as a track to run/play the toy car.

In accordance with one embodiment of the present disclosure, the container element (102) is further configured to contain a car launcher (106). Using the car launcher (106), it can be possible for a child to launch the toy car or displace the toy car with another toy instead of pushing the car manually. This adds to the fun in playing with the toy car using the packaging box (100) of the present invention.

The car launcher (106) comprises a spring mechanism, wherein the spring (106A) displaces a piston (106B) and the piston head (106C) abuts the toy car body and the kinetic energy of the piston (106B) is transferred to the toy car, thereby displacing the toy car (100A).

In accordance with an embodiment of the present disclosure, said at least one lateral foldable sidewall (102C) of said container element (102) has an aperture (108) configured for facilitating placement of at least a portion of said car launcher (106), in a folded configuration of said at least one lateral foldable sidewall (102C).

In an embodiment, the at least one upright longitudinal sidewall has a first pair of foldable extensions (110A, 110B) configured to facilitate the folding and unfolding of the at least one lateral foldable sidewall (102C). More specifically, the folding and unfolding of the at least one lateral foldable sidewall (102C) is facilitated by live hinges formed between the at least one upright longitudinal sidewall (102B) and the first pair of foldable extensions (110A, 110B), and between the first pair of foldable extensions (110A, 110B), the at least one lateral foldable sidewall (102C), and between the at least one lateral foldable sidewall (102C) and the base (102A).

In an embodiment, the assembly of the first pair of foldable extensions (110A, 110B) and the at least one upright longitudinal sidewall (102B) of the container element (102) are facilitated by complementary engagement formations formed on the first pair of foldable extensions (110A, 110B) and the at least one upright longitudinal sidewall (102B) of the container element (102). More specifically, male type protrusions and female type slots can be configured on the first pair of foldable extensions (110A, 110B), the at least one upright longitudinal sidewall (102B) and the at least one upright longitudinal sidewall (102B) to facilitate the assembly. In yet another example, the fitment between the aforementioned complementary engagement formations can be facilitated via magnetic connection.

Alternative fitment ways can also be devised.

In accordance with one embodiment of the present disclosure, the lid element (104) has a transparent portion (104T) for facilitating viewing of said toy car (100A) within said packaging box (100). In an embodiment, the transparent portion (104T) can span the whole area of the lid element (104), whereas in some other embodiment, the transparent portion (104T) can span only a portion of the lid element (104). In still some other embodiment, the transparent portion (104T) can be in some pattern or abstract form with intermittent opaque portions.

A track (T) can be formed by engaging or connecting together the at least one lateral foldable sidewall (102C) of said container element (102) and the at least one lateral foldable sidewall (104C) of said lid element (104), when said at least one lateral foldable sidewall (102C) of said container element (102) and the at least one lateral foldable sidewall (104C) of said lid element (104) is in an unfolded configuration. Typically, the at least one lateral foldable sidewall (102C) of said container element (102) and the at least one lateral foldable sidewall (104C) of said lid element (104) connect or engage by means of complementary engaging formations configured thereon. The track (T) can be utilized for displacing the toy car (100A) thereon. More specifically, the at least one lateral foldable sidewall (102C) of the container element (102) and the at least one lateral foldable sidewall (104C) of the lid element (104) are configured to connect via male type protrusions and female type slots that are configured thereon. Alternately, a fitment between said complementary engagement formations may be facilitated via magnetic connection.

The packaging box (100) is configured by said at least one lateral foldable sidewall (102C) of said container element (102) and said at least one lateral foldable sidewall (104C) of said lid element (104), wherein the sidewalls (102C) and (104C) connect together by means of complementary engaging formations configured thereon, when said at least one lateral foldable sidewall (102C) of said container element and at least one lateral foldable sidewall (104C) of said lid element (104) are in a folded configuration. The fitment between said complementary engagement formations is facilitated via male type protrusions and female type slots can be configured on said at least one lateral foldable sidewall (102C) of said container element (102) and said at least one lateral foldable sidewall (104C) of said lid element (104).

It is to be noted that the multiple packaging boxes (100) can be interacted and assembled together to define multiple parallel tracks T. Any number of combination of tracks are possible depending upon the number of packaging boxes (100) available with the user. More the number of packaging boxes (100), more is the fun for the user in assembling tracks of different profiles. In one embodiment, several packaging boxes (100) with several toy cars can be arranged together in one big package.

The folding and the unfolding of the at least one lateral foldable sidewall (102C) is hereinafter described with reference to FIG. 5A through FIG. 5C. In FIG. 5A, the dotted lines represent the presence of live hinges on the body of the container element (102). As can be seen, a live hinge is configured between the upright longitudinal sidewall (102B) and the foldable extension (110A). Further, another live hinge is configured between the foldable extension (110A) and the foldable extension (110B). Yet another live hinge is configured between the base (102A) and the lateral sidewall (102C). The purpose of providing the live hinges is to provide the relative pivotal motion between the corresponding relevant panels of the container element (102).

Reference is hereinafter directed to FIG. 5B and FIG. 5C. In FIG. 5B, the lateral walls (102C) are folded and upright. However, the manner in which the lateral walls (102C) unfold with the help of the live hinges and the foldable extensions (110A, 110B) can be better observed in FIG. 5C.

The packaging box of the present disclosure has been described with reference a packaging box having a rectangular shape. However, it is to be noted that the packaging box of the present disclosure can have any other geometric and/or non-geometric shape, without departing from the scope of the present disclosure.

Further, the packaging box can be made up of paper, cardboard, plastic, light weight composites, metals and any combination thereof.

Though, the present disclosure is explained with reference to a toy car and packaging box for the same, it is evident that without departing from the scope of the present disclosure, the packaging box can be employed for packaging any other toys, objects including, but not limited to, ornaments, electronic devices, and the like.

Although embodiments for packaging box have been described in language specific to structural features and/or methods, it is to be understood that the invention is not necessarily limited to the specific features or methods described. Rather, the specific features and methods are disclosed as exemplary embodiments of the system and the method described herein.

I claim:

1. A packaging box for a toy car, said packaging box comprising:

a container element configured to contain said toy car, said container element having a base;

at least one upright longitudinal sidewall extending from at least one longitudinal side of said base; and at least one lateral foldable sidewall extending from at least one lateral side of said base;

wherein in a folded configuration of said at least one lateral foldable sidewall, said container element defines a box-like structure for containing said toy car;

a lid element configured to be assembled with said container element to define said packaging box, said lid element having a top;

at least one upright longitudinal sidewall extending from at least one longitudinal side of said top; and at least one lateral foldable sidewall extending from at least one lateral side of said top;

characterized in that, said at least one lateral foldable sidewall of said container element and said at least one lateral foldable sidewall of said lid element, each in an unfolded configuration thereof are engageable with each other to define a track for said toy car to be displaced thereon.

2. The packaging box as claimed in claim 1, wherein said container element is further configured to contain a car launcher.

3. The packaging box as claimed in claim 2, wherein said at least one lateral foldable sidewall of said container element has an aperture configured for facilitating placement of at least a portion of said car launcher, in a folded configuration of said at least one lateral foldable sidewall.

4. The packaging box as claimed in claim 1, wherein said at least one upright longitudinal sidewall has a first pair of foldable extensions configured to facilitate the folding and unfolding of the at least one lateral foldable sidewall.

5. The packaging box as claimed in claim 4, wherein said at least one upright longitudinal sidewall and said first pair of foldable extensions, the base of the container and said at least one lateral foldable sidewall are connected by means of live hinges.

6. The packaging box as claimed in claim 5, wherein the assembly of said first pair of foldable extensions and said at least one upright longitudinal sidewall of said container element are facilitated by complementary engagement formations formed on said first pair of foldable extensions and said at least one upright longitudinal sidewall of said container element.

7. The packaging box as claimed in claim 6, wherein a fitment between said complementary engagement formations is facilitated via magnetic connection.

8. The packaging box as claimed in claim 1, wherein said lid element can have a transparent portion for facilitating viewing of said toy car within said packaging box.

9. The packaging box as claimed in claim 1, wherein said at least one lateral foldable sidewall of said container element and at least one lateral foldable sidewall of said lid element are configured to connect together by means of complementary engaging formations configured thereon, when said at least one lateral foldable sidewall of said container element and at least one lateral foldable sidewall of said lid element is in an unfolded configuration, thereby defining said track for said toy car to be displaced upon.

10. The packaging box as claimed in claim 9, wherein a fitment between said complementary engagement formations may be facilitated via magnetic connection.

11. The packaging box as claimed in claim 1, wherein said at least one lateral foldable sidewall of said container element and said lid element are configured to connect together by means of complementary engaging formations configured thereon, when said at least one lateral foldable sidewall of said container element and said lid element are in a folded configuration, thereby defining said packaging box.

12. The packaging box as claimed in claim 11, wherein a fitment between said complementary engagement formations is facilitated via magnetic connection.

* * * * *